United States Patent [19]

Winter

[11] Patent Number: 4,833,801

[45] Date of Patent: May 30, 1989

[54] SNOW PLOW GUARDS

[76] Inventor: Kent L. Winter, P.O. Box 463, 38255 Ridge Rd., Willoughby, Ohio 44094

[21] Appl. No.: 154,911

[22] Filed: Feb. 11, 1988

[51] Int. Cl.[4] ..... E01H 5/06

[52] U.S. Cl. ..... 37/270; 37/141 R; 172/701.2; 172/719

[58] Field of Search ..... 37/270, 141 R, 141 T, 37/198, 214, 218; 172/772, 772.5, 745, 769, 719, 701, 701.2

[56] References Cited

U.S. PATENT DOCUMENTS

| | | | |
|---|---|---|---|
| Re. 31,045 | 10/1982 | Essell et al. . | |
| 298,088 | 5/1884 | Holden et al. | 37/198 |
| 2,148,925 | 2/1939 | Bochy | 172/745 |
| 2,718,162 | 9/1955 | Smith | 172/719 |
| 2,965,989 | 12/1960 | Hibbard | 172/701.2 |
| 3,197,895 | 8/1965 | Cooke | 37/141 R X |
| 3,281,972 | 11/1966 | Kerestes | 172/719 X |
| 3,638,736 | 2/1972 | Hahn | 37/141 R |
| 3,888,027 | 6/1975 | Toews | 37/141 R |
| 4,007,550 | 2/1977 | Stepe | 172/701.2 X |
| 4,047,312 | 9/1977 | Stepe | 37/141 R |
| 4,275,514 | 6/1981 | Maura . | |
| 4,290,214 | 9/1981 | Stepe | 172/701.2 |
| 4,356,645 | 11/1982 | Hine et al. . | |
| 4,357,766 | 11/1982 | Croteau et al. . | |
| 4,667,426 | 5/1987 | Howard et al. . | |
| 4,715,450 | 12/1987 | Hallissy et al. | 37/141 R |

FOREIGN PATENT DOCUMENTS

| | | | |
|---|---|---|---|
| 518818 | 2/1931 | Fed. Rep. of Germany | 172/719 |
| 1080937 | 4/1960 | Fed. Rep. of Germany | 37/141 R |

*Primary Examiner*—E. H. Eickholt

*Attorney, Agent, or Firm*—Watts, Hoffmann, Fisher & Heinke Co.

[57] ABSTRACT

Guards for replaceable attachment to a snow plow blade near the outer ends of its cutting edge are shown. Each guard has a panel portion conforming generally to these outer ends; that portion is of a hard, impact resisting metal of high shear strength, and it has a lower margin running for at least that part of its length that extends with the cutting edge of the blade. The exterior end of at least one of the guards projects around the end of the cutting edge as a curb feeler. Also shown is a snow plow with a moldboard having an expendable cutting edge along its bottom, and attached to each end of the cutting edge, a guard of the above-described sort.

7 Claims, 1 Drawing Sheet

SNOW PLOW GUARDS

TECHNICAL FIELD

This application relates to snow plows and more specifically to guards for the cutting edge, i.e. blade, thereof.

BACKGROUND ART

Usually the heavy steel cutting edge (blade) is expendable and is removably, e.g., with bolts, to the bottom of the plow moldboard. It scrapes along the pavement and can wear out in 8 to 10 hours. The wear often is uneven, and blades (cutting edges) sometimes break during plowing. Plows also often encounter substantial curb wear which can require major rebuilding. All this maintenance is costly.

The present invention can increase blade (cutting edge) life by 3 to 5 times, reduce blade breakage, protect blade ends from curb wear, and protect the moldboard.

BROAD STATEMENT OF INVENTION

One aspect of this invention is a pair of guards. They are adapted for replaceable attachment to a snow plow blade near the outer ends of its cutting edge. Each guard comprises a panel of hard, impact resisting metal of high shear strength. It conforms to the outer end of the blade to which it is to attach, and it has a reconstitutable abrasion resisting lower margin or skirt running for at least that portion of its length that extends with the cutting edge of the blade. The exterior end of at least one of the guards projects around the cutting edge of the blade to act as a curb feeler and side protector.

Another aspect of this invention is a snow plow moldboard having attached thereto an expendable cutting edge along its bottom, and attached to each outer end of its cutting edge; guards as defined in claim 1.

BEST MODE FOR CARRYING OUT THE INVENTION

Figure 1:
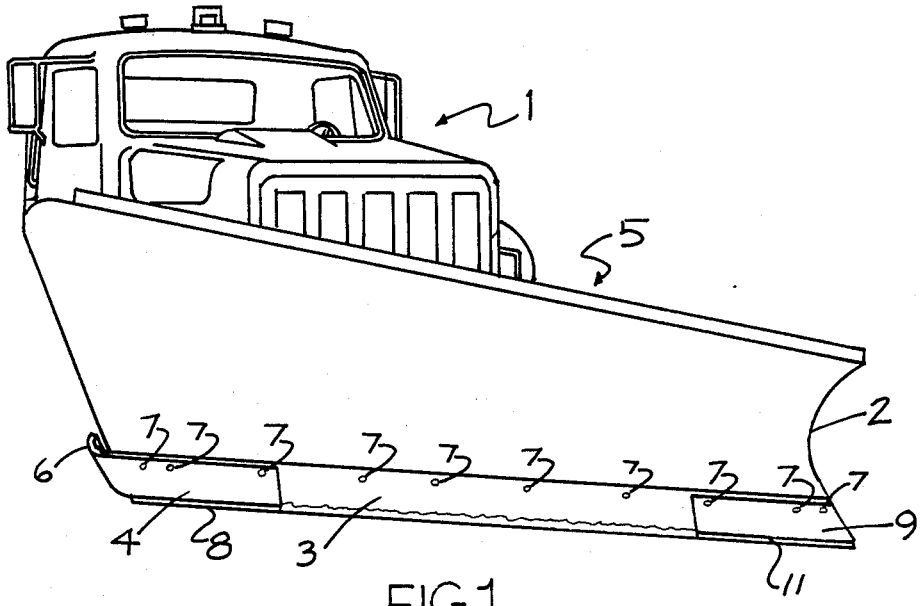
FIG. 1 is an isometric view of the inventive plow with the instant plow guards mounted on the front of a truck.

Truck 1 has conventionally mounted thereon snow plow 5 with diagonally-oriented steel moldboard 2. The bottom of the moldboard is fitted along its 10-foot length with a 1 inch thick steel blade (cutting edge) 3. On the right side of the blade 3 is lane side guard 9. The blade 3, the right guard and the left guard 9 are attached to the moldboard 2 with bolts 7; the bolt holes of the two guards are in register with those of blade 3 so as to obtain bolting attachment of these parts to the moldboard together where the guards overlap the blade. Standard ⅝" diameter square head bolts are used.

The essentially flat or panel portion of each guard is 20 inches long, 8 inches high, and 1 inch thick armor steel of the following analysis (balance iron):

| C | Mn | P | S | Si | Cr | B | Hardness Bhn |
|---|---|---|---|---|---|---|---|
| x100 | x100 | x1000 | x1000 | x100 | x100 | x100 | 363/401 |

-continued

| C | Mn | P | S | Si | Cr | B | Hardness Bhn |
|---|---|---|---|---|---|---|---|
| 16 | 140 | 16 | 16 | 525 | 26 | 0.4 | - |

The curb feeler 6 of guard 4 of the same material, but without bottom edge 8. Bottom edge 8 on the left guard 4 and bottom edge 11 on right guard 9 are clad with rounded weld metal to make a ⅝ inch deep buildup. The weld is across the full 1 inch thickness of the guard steel and runs the entire length of each panel portion. To create a back rake angle on the weld buildups of items 8 and 11, a single ½ inch width bead is deposited along the leading (front) edges of the welds. These edges scrape the pavement as the plow moves. The weld deposits 8 and 11 have the following analysis (balance iron):

| C | Cr | Mo | Si | Mn |
|---|---|---|---|---|
| x100 | x100 | x100 | x100 | x100 |
| 2.60 | 12.00 | 0.62 | 1.37 | 0.77 |
| Hardness/Rc | 55–60 | | | |

Typically conventional hard-facing or wear-facing weldments are used for this work. So-called chrome carbide steels are the most common, e.g., Stoody Company No. 121, although vanadium carbide (Stoody No. 134) and tungsten carbide ones also can be used very effectively.

Figure 2:
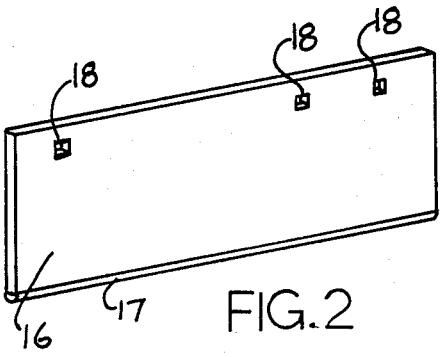
FIG. 2 is an isometric view of a "lane side" plow guard.

The lane side guard of FIG. 2 has panel portion 16 with weldment 17 on its bottom, and bolt holes 18 near its top. Stand the guard of FIG. 3 are made like those corresponding in FIG. 1.

Figure 3:
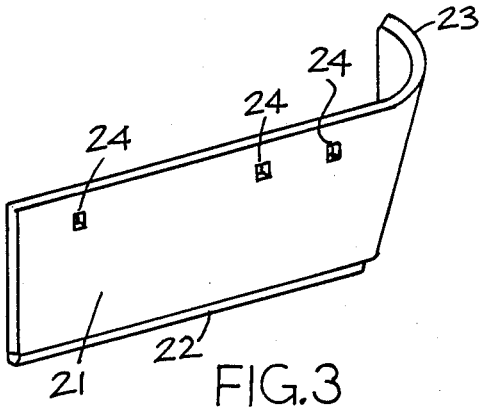
FIG. 3 is an isometric view of a "left curb side" guard with the wraparound curb feeler.

The left curb side guard of FIG. 3 has panel portion 21 with weldment 22 on its bottom and bolt holes 24 near its top. It also has curb feeler and side protector 23 extending around its right side.

While the moldboard and blade has been shown with diagonal orientation, clearly they could be straight or vee-shaped or of other conventional orientation.

The greater the impact resistance, shear strength, and hardness of the panel sections, generally the better. Accordingly, armor steels are preferred, typically ones with high chromium, carbon and silicon contents. Other armor steels, quenched and tempered ultraservice steels, and maraging steels also are useful here.

The weldment metal must be abrasion-resistant. Generally, it is a high chrome ferrous metal weld. It is reconstitutable in the sense that it can be repaired or replaced by, of course, redeposition of metal by welding. Alternatively, one or more strips of metal generally resembling the sort deposited could be welded, or otherwise conventionally attached, but would be more expensive to replace or rebuild than a weldments of the drawing figures.

While the curb feeler has been shown one side of the plow of FIG. 1, both guards can be so shaped for a curb feeler on each or either side. Also, while 3 bolt holes and 20-inch long guards are illustrated, guards can be longer and have more holes or be short as 12 inches and have only two bolt holes; they usually have a shorter life.

Many other modifications and variations of the invention will be apparent to those skilled in the art in the light of the foregoing disclosure and drawings. Therefore, it is to be understood that, within the scope of the appended claims, the invention can be practiced otherwise than has specifically been shown and described.

I claim:

1. A metal guard adapted for replaceable attachment to the front of an outer end of the expendable metal blade disposed across the base of a moldboard on a snowplow, the guard being attached for extending the service life of the blade and comprising:

a panel portion that conforms generally to the front outer end of the blade where the guard is to be attached, the panel portion having a reconstitutable, abrasion-resistant lower margin running for that part of its length that is to extend with the blade, the guard having an outboard terminal portion that is integral with the panel portion and is supported by the panel portion, and the outboard terminal portion sweeping to the rear of the blade to act as a curb feeler when the guard is attached to the end of the blade.

2. A metal guard in accordance with claim 1 wherein a set of two metal guards are provided for attachment to the opposite ends of a snow plow blade, and the outboard terminal portion of one of the set is an optional feature.

3. The guard of claim 1 wherein the panel portion and said outboard terminal portion are of steel, and the reconstitutable lower margin of the panel portion is a deposit of weld metal.

4. The guard of claim 1 wherein both the panel portion and the blade to which it is to be attached are perforated for fastening, the resulting perforations of the panel portion being in register with the outer ones of said blade, and the guard is about the height of the blade and is about one to two feet long.

5. In a snowplow having a moldboard with an expendable metal blade fastened across its bottom front, the improvement for extending the serice life of the blade which comprises:

a metal guard replaceably attached to the front of each end of the blade, each guard consisting essentially of:

a panel portion that conforms generally to a front outer end of the blade where the guard is attached, the panel portion of each guard having a reconstitutable, abrasion-resistant lower margin running for that part of its length that extends with the blade, at least one of the guards also having an outboard terminal portion that is integral with and is supported by its panel portion, the outboard terminal portion sweeping to the rear of the blade to act as a curb feeler.

6. The snowplow of claim 5 wherein the panel portions and the outboard terminal portion are of steel, and the reconstitutable lower margins of the panel portions are deposits of weld metal.

7. The snowplow of claim 5 wherein the panel portions and the blade to which they are attached are perforated for fastening, the resulting perforations being in register with the outer ones of said blade, and the guards are about the height of the blade and are about one to two feet long.

* * * * *